US005710388A

United States Patent [19]

Hutchinson et al.

[11] Patent Number: 5,710,388

[45] Date of Patent: Jan. 20, 1998

[54] UMBILICAL CORD FOR PROJECTILE LAUNCHING DEVICE

[75] Inventors: James David Hutchinson, Walthamstow; Jonathan Nunn, Middelsec, both of Great Britain

[73] Assignee: The Whitaker Corporation, Wilmington, Del.

[21] Appl. No.: 695,733

[22] Filed: Aug. 12, 1996

[30] Foreign Application Priority Data

Aug. 16, 1995 [GB] United Kingdom ..... 9516804

[51] Int. Cl.[6] ..... F41F 3/04; H01R 17/00

[52] U.S. Cl. ..... 89/1.811; 439/660

[58] Field of Search ..... 89/1.811, 1.8, 89/6.5; 439/207, 208, 660, 682, 690; 244/3.2

[56] References Cited

U.S. PATENT DOCUMENTS

| | | | |
|---|---|---|---|
| 2,526,325 | 10/1950 | Burtt et al. | 439/690 |
| 2,786,393 | 3/1957 | Grimes | 89/1.811 |
| 2,951,421 | 9/1960 | Katzen | 89/1.811 |
| 3,072,021 | 1/1963 | Marcon | 89/1.811 |
| 3,111,355 | 11/1963 | Samburoff et al. | 89/1.811 |
| 3,122,403 | 2/1964 | McKee et al. | 89/1.811 |
| 3,158,060 | 11/1964 | Semenoff et al. | 89/1.55 |
| 3,158,613 | 11/1964 | Alpert | 89/1.811 |
| 3,193,790 | 7/1965 | Boyle et al. | 89/1.811 |
| 3,432,802 | 3/1969 | Ritchie | 439/690 |
| 3,611,274 | 10/1971 | Low | 89/1.811 |
| 3,780,617 | 12/1973 | Tabarie et al. | 89/1.811 |
| 3,883,209 | 5/1975 | Kongelbeck | 89/1.811 |
| 4,047,464 | 9/1977 | Fredriksson et al. | 89/1.811 |
| 4,099,038 | 7/1978 | Purdy | 200/61.08 |
| 4,184,731 | 1/1980 | Betzmeir | 89/1.811 |
| 4,863,397 | 9/1989 | Hatch, Jr. | 439/475 |
| 5,042,357 | 8/1991 | Schaff et al. | 102/293 |
| 5,513,065 | 4/1996 | Caveney et al. | 361/311 |
| 5,554,036 | 9/1996 | Shirai et al. | 439/660 |
| 5,588,877 | 12/1996 | Davis et al. | 439/660 |
| 5,626,490 | 5/1997 | Pitts et al. | 439/404 |

OTHER PUBLICATIONS

British Search Report, Oct. 1996.

*Primary Examiner*—Michael J. Carone
*Assistant Examiner*—Theresa M. Wesson

[57] ABSTRACT

An umbilical cord for connecting the control systems within a control center to the operating systems of a projectile that is located within a launch tube and is to be launched therefrom, the umbilical cord comprising a cable having a plurality of conductors therein and having a control center end and a projectile end, a first connector terminated to the conductors at the control center and at a second connector terminated to the conductors at the projectile end, the second connector having insulation displacement contacts therein where the conductors are terminated and the second connector is captivatively pluggable into a recess in the side of the projectile through a port in the launch tube and upon the launching of the projectile, the connector remains with the projectile and the conductors remain with the launch tube, whereby the conductors are pulled free from the insulation displacement contacts.

12 Claims, 6 Drawing Sheets

UMBILICAL CORD FOR PROJECTILE LAUNCHING DEVICE

BACKGROUND OF THE INVENTION

1. Field of the Invention

This invention relates to an electrical connection for a projectile launching device.

2. Description of the Prior Art

In modern projectile launching devices, a control centre is employed as part of the system. This control centre has control circuitry therein that must be reliably connected to the operating systems within a projectile up to the moment of launch. Furthermore, after launch has occurred there must be no trailing debris extending from the projectile. Therefore, it is necessary that the interconnection cleanly separate from the projectile.

SUMMARY OF THE INVENTION

These and other objects are accomplished by providing an umbilical cord for connecting the control systems within a control center to the operating systems of a projectile that is located within a launch tube and is to be launched therefrom, the umbilical cord comprising a cable having a plurality of conductors therein and having a control center end and a projectile end, a first connector terminated to the conductors at the control center and at a second connector terminated to the conductors at the projectile end, the second connector having insulation displacement contacts therein where the conductors are terminated and the second connector is captivatively pluggable into a recess in the side of a projectile through a cord in the launch tube and upon the launching of the projectile, the connector remains therewith and the conductors remain with the launch tube whereby they are pulled from the insulation displacement contacts.

Advantageously then, the invention provides a simple and effective umbilical cord for connecting the control systems to the operating systems of a projectile in a manner that enables communication up to and during the instant of launch. It is another advantage of this invention that shielding could be provided along the conductors at the second connector so that as the conductors are pulled therefrom the operating systems of the projectile would remain essentially shielded providing EMI shielding to the circuitry therein. It is yet another advantage of this invention that by providing connectors at each end of the cable the umbilical cord may be made disposable. It is still another advantage of this invention that a boot may be provided over the cable thereby sealing the port so that a sealed interconnection is maintained. It is still yet another advantage of this invention that the umbilical cord may be reliably attached to the launch tube so that the umbilical cord may be used to transport lighter assemblies incorporating the present invention.

DETAILED DESCRIPTION OF THE PREFERRED EMBODIMENT

Figure 1:
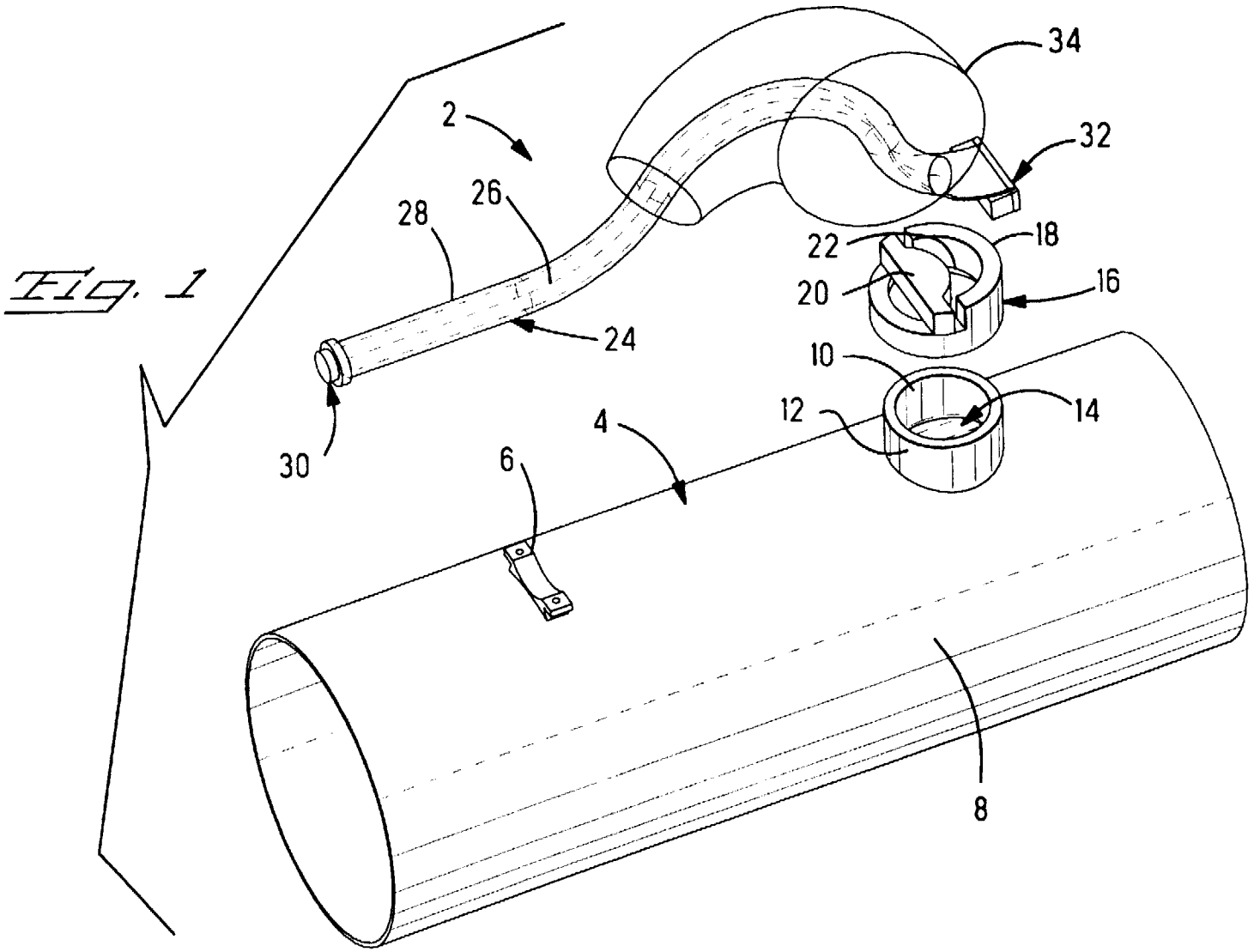
FIG. 1 is a partially exploded upper perspective view of a representation of the present invention.

With reference first to FIG. 1, an umbilical cord according to the present invention is shown generally at 2. The umbilical cord 2 is mountable upon a launch tube 4 by way of a saddle 6 that would include an overlying top portion (not shown) for captivating the umbilical cord 2 therebetween. The tube 4 further includes a body 8 upon which a port 10 is provided transversely therethrough where the port 10 may advantageously be surrounded by an outwardly extending lip 12. Within the tube 4 is a projectile 14 that is to be launched therefrom. It may be desirable to also provide a strain relief 16 that would fit over the lip 12 in order to arrest another portion of the umbilical cord 2 that is separated from the saddle 6. The strain relief 16 is of conventional construction and includes a body portion 18 and a movable anvil 20 for captivating the cord 2 in the space 22 therebetween.

The umbilical cord 2 includes a cable 24 having a plurality of conductors 26 therein. The conductors 26 are surrounded by a protective jacket 28 that further provides environmental protection to the conductors. At opposite ends of the cable 24 are located a first connector 30 and a second connector 32. The first connector 30 is terminated to the conductors 28 and would be connected in communication with control systems within a control centre that must be coupled to the projectile 14 in order to ensure adequate instructions and sensing communication occurs therebetween. The second connector 32 is terminated to the conductors 26 of the cable 24 at the opposite end of the cable 24 to the first connector 30 and is sized to fit through the port 10 and be pluggably received within the projectile 14 in a manner that assures the connector 32 is captivated thereto. It may also be desirable to have a protective boot 34 generally surrounding the cable 24 and being affixable at one end to the lip 12 to form a seal therewith. Provided adequate strain relief is provided by the strain relief 16 and the anchoring point 6 it may be possible to use the umbilical cord 2 or boot 34 as a carrying strap for the tube 4 and the projectile 14 therein.

Figure 2:
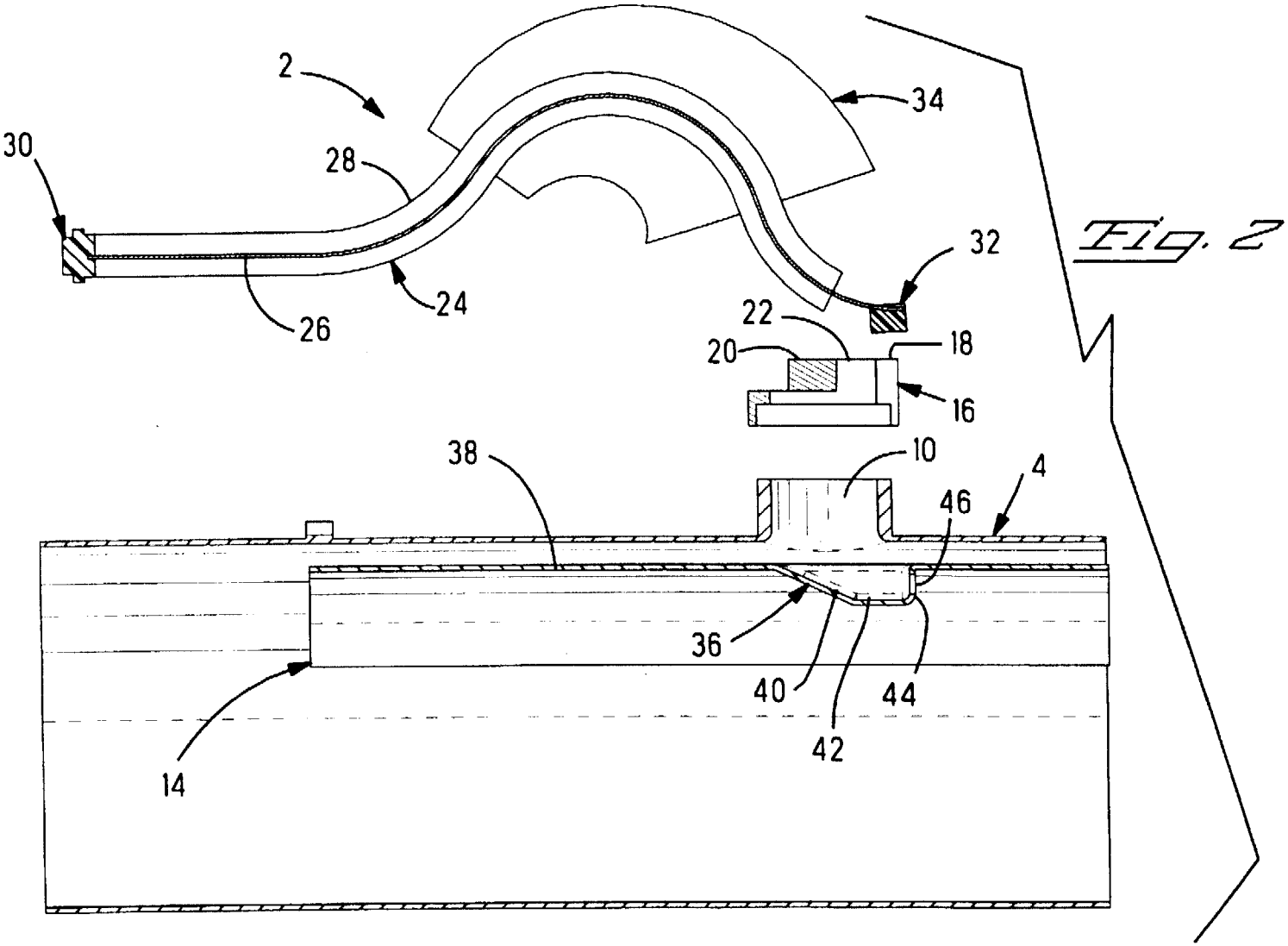
FIG. 2 is a side view of the representation of FIG. 1.

With reference now to FIG. 2, the launch tube 4 is shown partially cutaway and a representation of a portion of the projectile 14 is shown positioned therein. The projectile 14 includes an interface recess 36 within an outer surface 38 thereof that includes a tapered rear surface 40, a base surface 42 and a forward surface 44 having a window 46 therein through which the connector 32 may be pluggably received in order to mate with a corresponding connector interface (not shown). The interface recess 36 is aligned to correspond with the port 10 when the projectile 14 is properly positioned within the launch tube 4. In this position, the second connector 32 may be fed through the port 10 into the recess 36 and plugged into the mating interface within the projectile. With the interface recess 36 properly formed and configured, the connector 32 remains within the outer profile 38 and does not extend therefrom.

Figure 3:
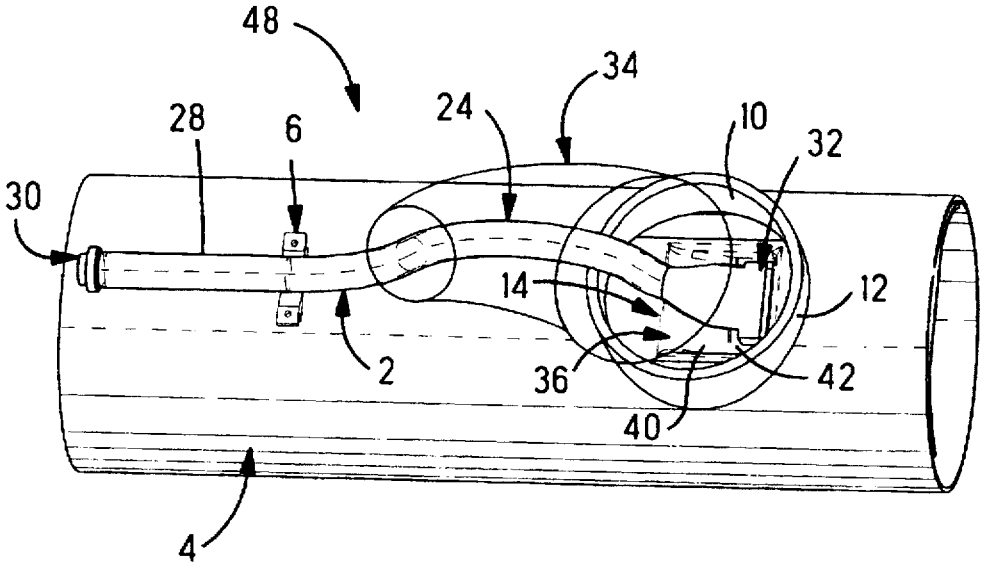
FIG. 3 is an upper perspective view of the assembled representation of FIG. 2 with the strain relief removed for clarity.
Figure 4:
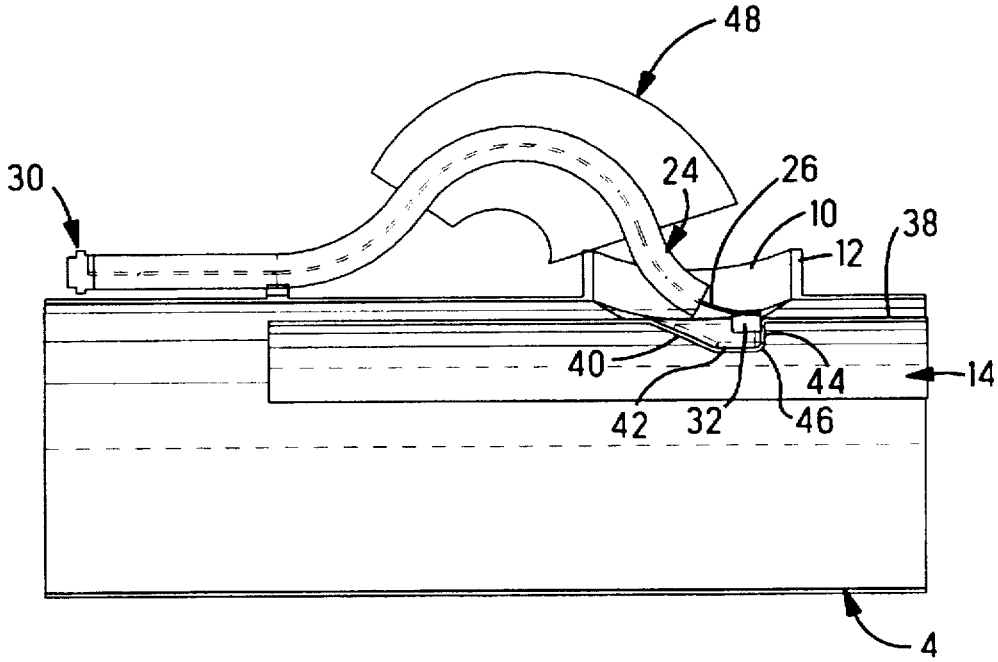
FIG. 4 is a side partially cut away view of the assembly of FIG. 3.

With reference now to FIG. 3, a fully assembled launch apparatus is shown generally at 48. The strain relief 16 has been omitted for clarity. As can be observed, the umbilical cord 2 is affixed to the launch tube 4 at the anchor point 6. A first connector 30 extends rearward therefrom so that it may be coupled to a complementary connector on another cable or directly to an electronic apparatus that is in communication with the control centre (not shown). The second connector 32 is shown mounted within the interface recess 36 of the projectile 14 so that the cable 24 extends outward therefrom through the port 10. As can be imagined, once the connector 32 is fed through the port 10 it fits down along the angled surface 40 until it reaches the base 42, whereby it is correctly orientated and plugged into the interface window 46 of the face 44, as best seen in FIG. 4. As further shown in FIG. 4, it may be desirable to terminate the protective jacket 28 short of the connector 32 but within the lip 12 so that the strain relief 16 would engage the jacket, however the conductors 26 would extend therefrom and into the electrical connector 32. As is further shown, the electrical connector 32 is disposed below the outer surface 38 of the projectile 14 within the launch tube 4 so that it does not interfere with the tube 4 or the flight characteristics of the projectile 14.

Figure 5:
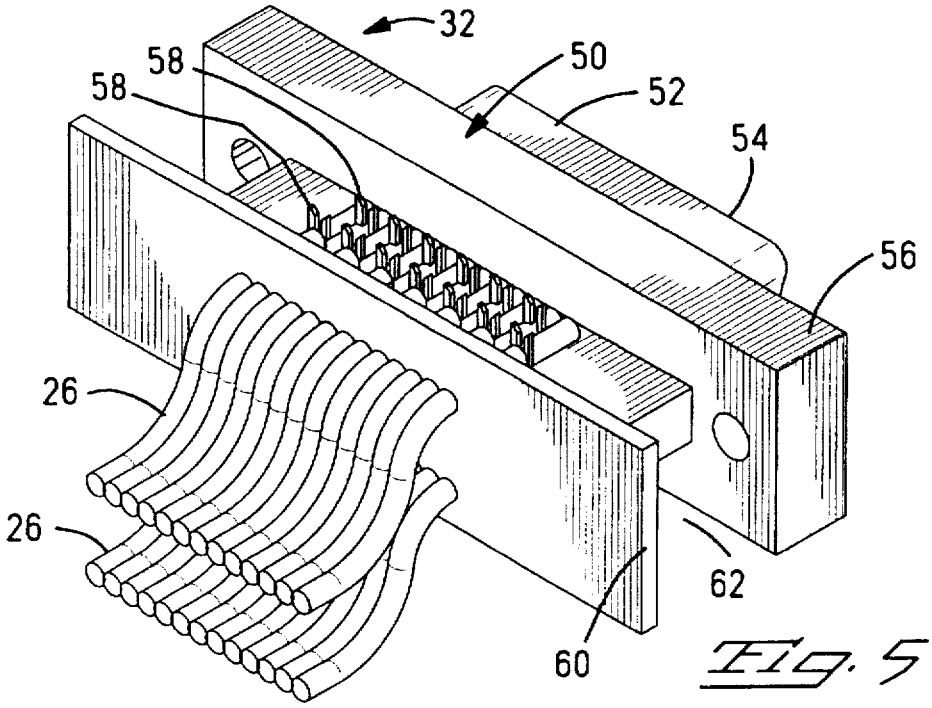
FIG. 5 is an upper perspective view of an electrical connector that may be utilized with the present invention.

With reference now to FIG. 5, the second electrical connector 32 is shown with an outer cover removed for clarity. The electrical connector assembly 32 includes a connector 50 having a front interface portion 52 having a mating face 54 wherein a plurality of terminal receiving passageways are exposed. A mounting flange 56 is disposed rearward therefrom and the connector 50 further includes upper and lower rows of insulation displacement contacts 58 for terminating the conductors 26. The conductors 26 extend through a metalized self healing structure 60. The structure 60 and the flange 56 define a space 62 therebetween that when the second connector 32 is fully assembled with the outer cover (not shown) is filled with a sealing compound, whereby contamination is prevented from entering the connector unit.

Figure 6:
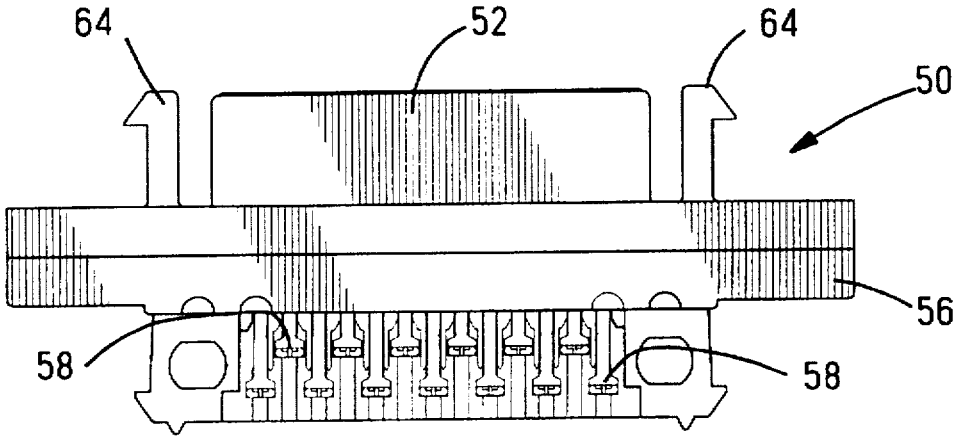
FIG. 6 is a top view of a connector portion of the electrical connector of FIG. 5.
Figure 7:
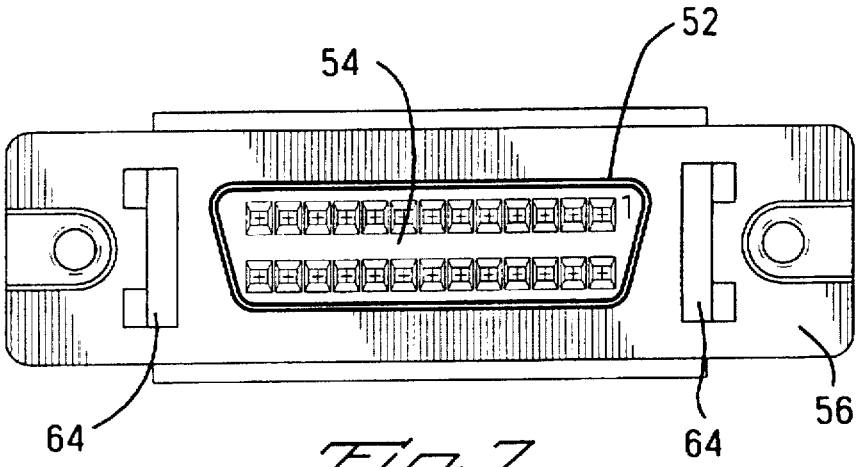
FIG. 7 is a front view of the connector of FIG. 6.
Figure 8:
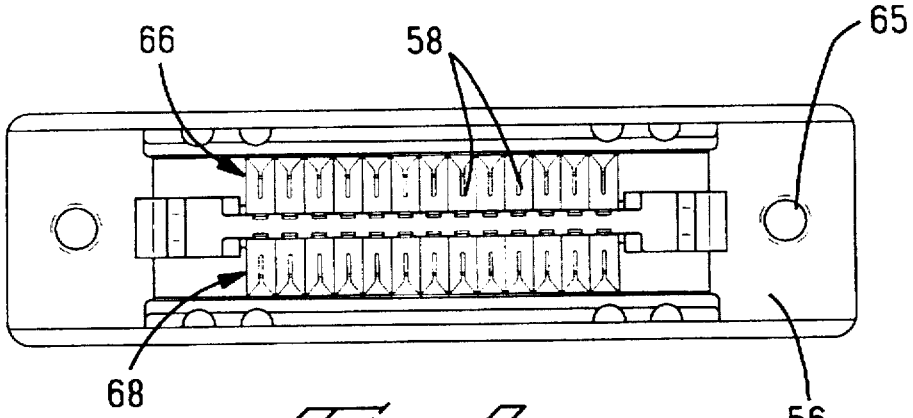
FIG. 8 is a rear view of the connector of FIG. 6.

With reference now to FIGS. 6–8, a particular connector 50 that is suited for this application is shown in more detailed form. The connector shown is a member of the AMP "AMPLIMITE" electrical connector series incorporating insulation displacement contacts. As observed in FIGS. 6–8, the connector 50 includes a pair of forwardly extending latch arms 64 on either side of the mating shroud 52. The latch arms 64 are for captively retaining the connector 50 within the recess 36 of the projectile 14. In addition, a pair of forwardly open screw fixing holes 65 may also be used for retaining the connectors together and the connector 50 attached to the projectile. Extending from the other side of the wall 56 is a row of insulation displacement contacts 58 arranged on a staggered pitch. This technology is well known and forms a reliable interconnection with an insulated conductor. Upper and lower rows 66,68 of contacts 58 may easily be seen in FIG. 8. The connector 50 may include metalized shielding shells thereabout. Other connector styles may be utilized having different interface configurations and the particular IDC structure shown is meant to be illustrative and not to be limiting upon the scope of the invention, as other IDC technology may be useful.

Figure 9:
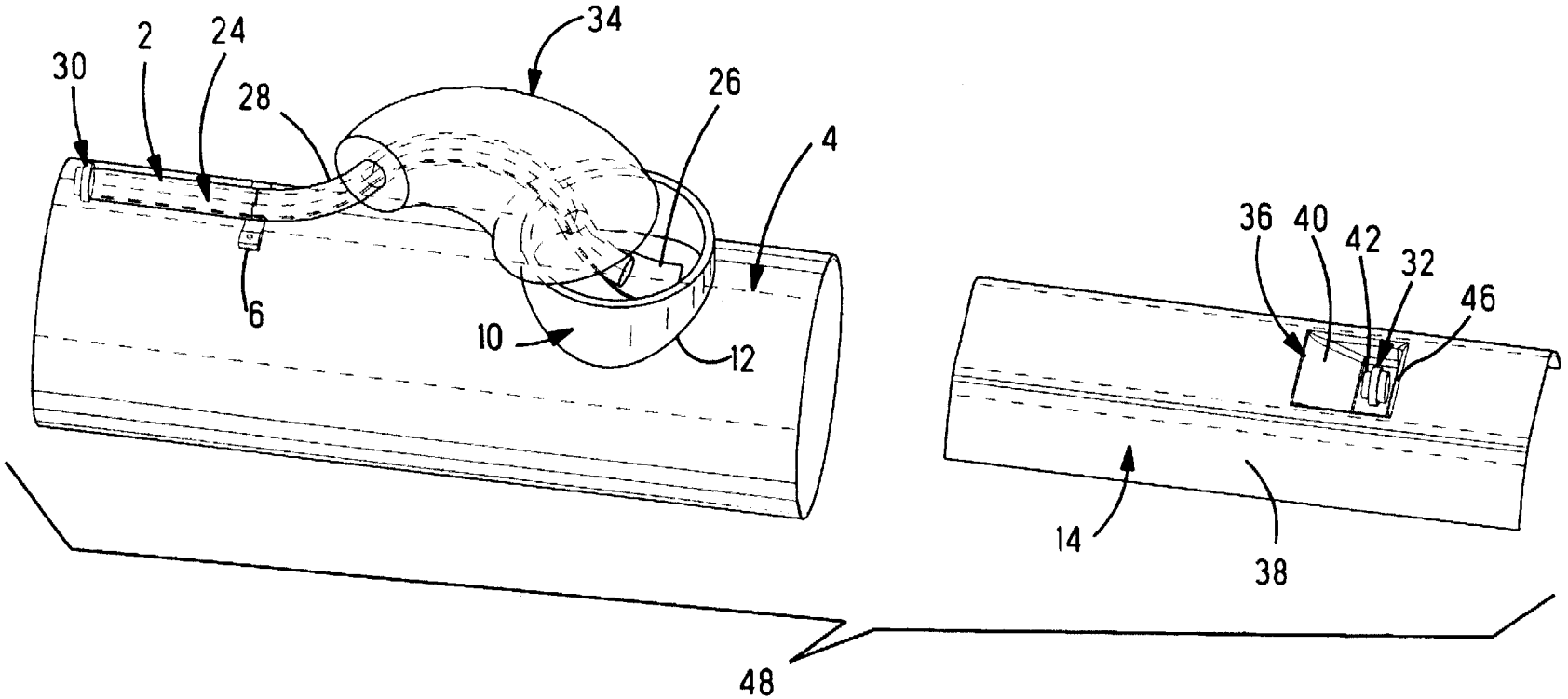
FIG. 9 is an upper perspective view of the representation of FIG. 1 showing the projectile leaving the launch tube.

With reference now to FIG. 9, the representation of the projectile launch assembly 48 is shown moments after the projectile 14 has left the launch tube 4. As may be observed, the connector 32 remains within the recess 36 of the projectile 14. As has been discussed, the second connector 32 is beneath the outer profile 38 of the projectile 14. Due to the anchoring of the umbilical cord 2 at the anchor point 6 on the outer surface 8 of the launch tube 4 and the strain relief 16 (omitted from this Figure for clarity), umbilical cord 2 remains attached to the launch tube 4 with the projectile end of the conductors 26 now having pulled free from the second connector 32 and remaining loose within the port 10 of the launch tube 4. If it is desired, this already used umbilical cord may be removed and a new umbilical cord may be placed and mounted upon the launch tube if it is desired to recycle the tubes 4. It is important to note that the umbilical cord 2 may be useful with structure other than a launch tube whereupon the projectile 14 would be simply hung from a anchor point or bulkhead. The launch tube 4 is simply a representation of a positioning structure from which the projectile 14 is launched and that remains behind once the projectile 14 is sent to flight.

Figure 10:
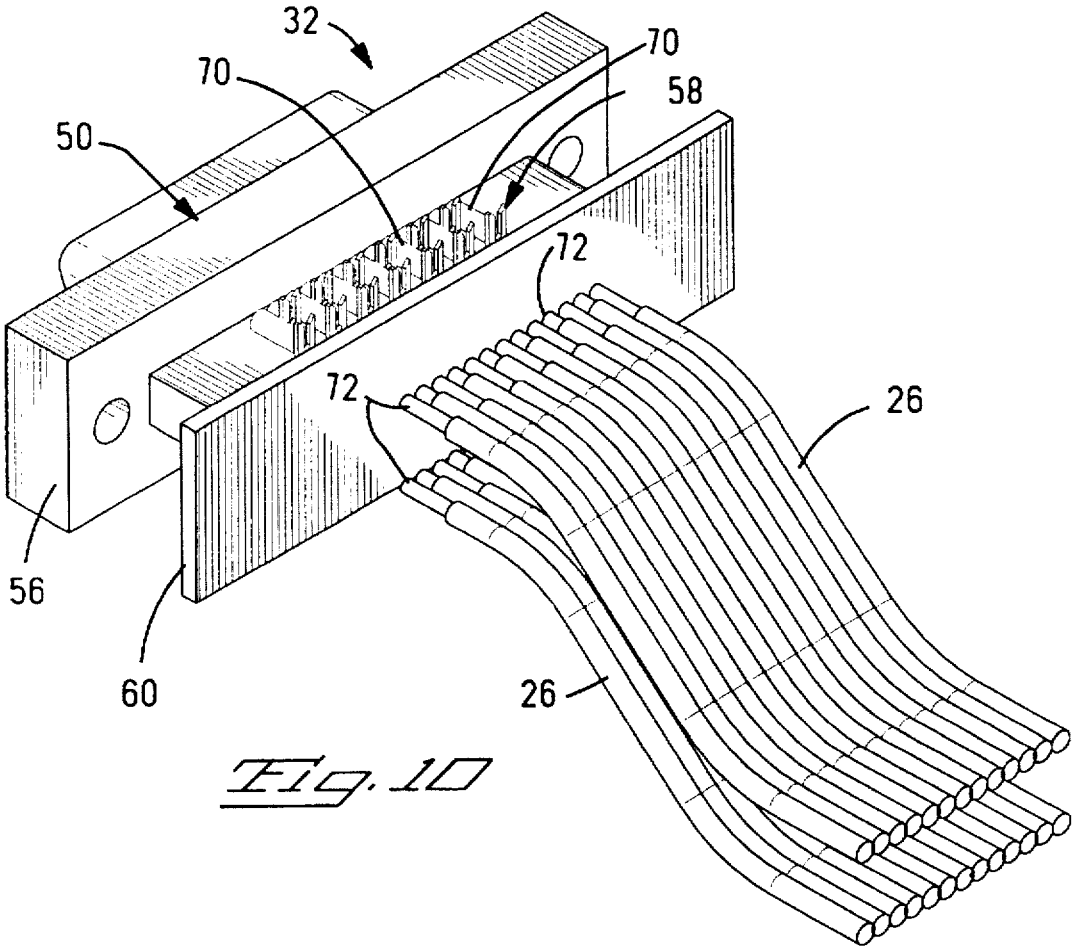
FIG. 10 is an upper rear perspective view of the electrical connector of FIG. 5 showing the conductors being displaced therefrom a moment after launch.

With reference now to FIG. 10, the second electrical connector 32 is shown a short instance after launch. The connector 50 has separated from the projectile and the conductors 26 that make up the cable 24 of the umbilical cord 2. As the launch occurs, the connector 50 remains attached to the projectile 14 as a result of the latch arms 64 (FIG. 6) and the conductors 26 remain fixed relative to the launch tube 4 as a result of the anchoring point 6 and the strain relief 14. The relative displacement results in the conductors 26 being pulled from their corresponding insulation displacement contacts 58. As the separation occurs, a small portion of insulation 70 that lies forward of the IDC contacts 58 may be stripped from the conductors 26 leaving exposed a conductive core 72. These small pieces of insulation 70 would possibly remain encapsulated within the sealing gel (not shown) that surrounds the contacts 58 and that is located between the intermediate plate 56 and the metalized seal healing structure 60 at the rear of the connector assembly 32. The self-healing nature of the shielding structure 60 is indicated by the lack of openings shown therein almost immediately after launch. The self healing shielding structure 60 acts to close off the pathways to the contacts 58 that would possibly provide a conductive path into the operating systems of the projectile 14 during the projectile's 14 flight. It is an obvious point that the engagement of the second connector 32 with the projectile 14 must be sufficient to withstand the forces exerted at the contacts 58.

We claim:

1. An umbilical cord for connecting control systems within a control center to operating systems of a projectile that is located within a launch tube and is to be launched therefrom, the umbilical cord comprising a cable having a plurality of conductors therein and having a first connector terminated to the conductors at a control center end and at a second connector terminated to the conductors at a projectile end, the second connector having insulation displacement contacts therein where the conductors are terminated and the second connector is captivatively pluggable into a recess in the side of a projectile through a port in the launch tube and upon the launching of the projectile, the second connector remains therewith and the conductors remain with the launch tube whereby they are pulled from the insulation displacement contacts.

2. The umbilical cord of claim 1, further characterized in that a shielding structure is provided at the second connector through which the conductors extend into the insulation displacement contacts, the shielding structure being constructed so that after launch, openings left in the shielding structure are closed, thereby closing a path to the contacts.

3. The umbilical cord of claim 2, wherein the shielding structure is a sealing gel.

4. The umbilical cord of claim 1, further characterized in that the umbilical cord carries a boot thereupon that is fixable to the launch tube at the port to form a seal therewith.

5. A launching assembly comprising a launch tube, a projectile provisionally attached to said tube prior to launching, and an umbilical cord for connecting control circuitry that is generally fixed relative the tube with operating systems within the projectile, the umbilical cord including a cable made up of a plurality of conductors and having a control circuitry end and an operating system end, the control circuitry end having a first connector thereupon and the operating system end having a second connector thereupon where the second connector contains contacts therein that are joined to conductors of the cable and the second connector is fixable to the projectile such that the force needed to displace the second connector from the projectile is greater than the force needed to pull the conductors from the contacts.

6. The assembly of claim 5, where the second connector includes insulation displacement contacts for terminating the conductors.

7. The assembly of claim 6 where the cable includes a jacket thereabout.

8. The assembly of claim 5, where the umbilical cord is firmly anchored to the tube.

9. The assembly of claim 5 where the tube has a port therethrough where through the umbilical cord passes.

10. The assembly at claim 9, wherein a strain relief is affixed to the port.

11. The assembly of claim 5, wherein a self healing shielding structure is included rearward of the contacts, the conductors extending through the structure when connected to the second connector and pulled therefrom upon launch, where the shielding structure blocks access to the contacts once the conductors are pulled therefrom.

12. The assembly of claim 11, wherein the shielding structure is a sealing gel.

* * * * *